United States Patent [19]

Ohkawa et al.

[11] 4,327,664

[45] May 4, 1982

[54] WET TYPE ELECTROSTATIC IMAGE DEVELOPING DEVICE

[75] Inventors: Yasuhiro Ohkawa, Chiba; Takashi Saito, Ichikawa, both of Japan

[73] Assignee: Canon Kabushiki Kaisha, Tokyo, Japan

[21] Appl. No.: 70,984

[22] Filed: Aug. 30, 1979

[30] Foreign Application Priority Data

Aug. 31, 1978 [JP] Japan ..... 53-106869

[51] Int. Cl.[3] ..... G03G 15/10

[52] U.S. Cl. ..... 118/661; 118/203

[58] Field of Search ..... 118/661, 203

[56] References Cited

U.S. PATENT DOCUMENTS 3,866,572 2/1975 Gundlach ..... 118/661 X 4,205,622 6/1980 Miyake et al. ..... 118/661

*Primary Examiner*—Bernard D. Pianalto

*Attorney, Agent, or Firm*—Fitzpatrick, Cella, Harper & Scinto

[57] ABSTRACT

A wet type electrostatic image developing device of a type, wherein a porous, resilient developing member, which is applied with a developing bias voltage and which impregnates therein developing liquid, is press-contacted to an electrostatic image carrier and rotated to carry out the wet-type development of the electrostatic image. In this developing device, a refreshing device which functions to exchange the developing liquid within the porous, resilient developing member press-contacted to the developing member is maintained in an electrically floated state so as to prevent generation between the porous, resilient developing member and the refreshing device of an electric field which causes developing toner to substantially migrate.

37 Claims, 3 Drawing Figures

WET TYPE ELECTROSTATIC IMAGE DEVELOPING DEVICE

BACKGROUND OF THE INVENTION

1. Field of the Invention

This invention relates to a wet type developing device, and, more particularly, it is concerned with a wet type developing device of a construction, in which a liquid developer is conveyed on a porous, resilient member having a liquid absorbing property and a liquid exuding property under pressure so as to feed the liquid developer to an image carrying body.

2. Description of the Prior Art

In laid-open Japanese patent application No. 52-40336, for example, there is disclosed a device of a construction, in which developing liquid is conveyed on a developing roller comprising a roller made of an electrically conductive, resilient foamed material and a resin net covering the surface of the resilient foamed roller. In this developing device, the developing roller is immersed at its lower part into a developing liquid accommodated in a liquid vessel, while its upper part is press-contacted to an image carrying body. At this press-contacted portion, the roller is subjected to elastic-deformation to ooze out the developing liquid impregnated therein and to feed the same to the image carrying body. The developing roller also has a refreshing roller press-contacted thereto in the liquid vessel. The refreshing roller has the functions of elastically deforming the developing roller to exude the developing liquid therefrom after use, and of absorbing fresh developing liquid thereinto at the time of its reinstatement into the original shape from the elastically deformed state.

In this developing device, it is not impossible to apply a bias voltage to the developing roller from the refreshing roller which is made an electrode. In view, however, of the fact that an insulative net is interposed between the electrode roller and the electrically conductive foamed body of the developing roller, the contact between the electrode roller and the electrically conductive foamed body is not stable, hence a developing potential to be formed on the developing roller is also not stable. A more favorable developed image can be obtained when the core of the electrically conductive foamed body of the developing roller is made of a metal, and the developing bias voltage is applied to the electrically conductive foamed body through this metal core. Even in this instance, too, it may happen that the electrically conductive foamed body of the developing roller contacts the refreshing roller at the press-contacted portion of both rollers through the insulative net, whereby the developing bias voltage inevitably leaks from the electrically conductive foamed body to the refreshing roller. By this leakage of the developing bias voltage, there occurs irregularity in the image density or irregular ground fogging over the developed image. Further, when the developing bias voltage is applied to the electrically conductive foamed body of the developing roller, if an intense electric field is generated across the developing roller and the refreshing roller, the following inconvenience would arise. That is, assume that the toner in the developing liquid consisting of the toner dispersed and suspended in the insulative carrier liquid is charged to the negative polarity. In case the refreshing roller functions equally to the positive polarity with respect to the developing roller, the toner moves from the developing roller to the side of the refreshing roller to lower the toner density in the liquid impregnated in the developing roller with the consequence that density of the developed image lowers. Further, the toner in muddy form accumulates on the surface of the refreshing roller. On account of this, a multitude of fine openings on the surface of the developing roller are clogged with the muddy toner, whereby the developing roller reduces its liquid absorbing and exuding properties, and the density of the developed image becomes much lower or non-uniform. Furthermore, due to muddling of the toner, toner consumption rapidly increases. Conversely, when the refreshing roller functions equally to the negative polarity with respect to the developing roller, the developing capability becomes unstable. In other words, as the result of excessive quantity of the toner moving toward the developing roller, the excess toner accumulates on the surface or in the interior of the developing roller to cause unreasonable increase in density of the developed image, or clogging of the fine openings in the developing roller to deteriorate its liquid absorbing and exuding properties. As the result of this, the image density conversely lowers or becomes nonuniform.

SUMMARY OF THE INVENTION

It is an object of the present invention to provide a developing device capable of obtaining a developed image of high image quality, in which the developing liquid is carried on a porous, resilient developing member to be fed to an image carrier.

It is another object of the present invention to provide a wet-type developing device which utilizes a porous, resilient developing member applied with a developing bias voltage, and which is capable of forming a developed image free from irregularity in image density.

It is still another object of the present invention to provide a wet type developing device which utilizes a porous, resilient developing member applied with a developing bias voltage, and which is capable of obtaining a developed image free from irregular ground fogging.

It is yet another object of the present invention to provide a wet-type developing device which utilizes a porous, resilient developing member applied with a developing bias voltage, and which is capable of preventing the developing member from clogging with muddy toner.

It is further object of the present invention to provide a wet-type developing device which utilizes a porous, resilient developing member applied with a developing bias voltage, and which is capable of preventing the density of the developed image from gradually increasing or decreasing.

The foregoing objects, other objects, characteristic features, and resulting effects therefrom of the present invention will become more apparent from the following detailed description, when read in conjunction with the accompanying drawing.

DESCRIPTION OF PREFERRED EMBODIMENTS

Figure 1:
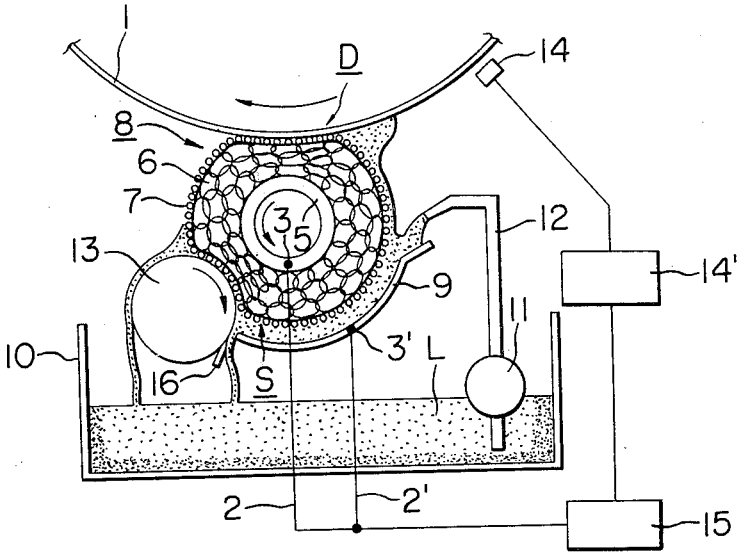
FIG. 1 is a schematic side elevational view showing a main part of one embodiment of the present invention.

Referring to FIG. 1, a reference numeral 1 designates a photosensitive drum having on its peripheral surface an electrophotographic sensitive member, and rotating in an arrow direction at a constant speed. Surrounding this drum 1, there are provided a well known electrostatic latent image forming device, a developing device as shown in the drawing, a well known image transfer device, and a well known cleaning device. In more detail, an electrostatic latent image formed on the drum 1 is subjected to wet development with the illustrated developing device, as the drum 1 rotates in the arrow direction, and the thus formed toner image is then transferred onto a paper. After the image transfer, the toner image is fixed onto the paper as the image transfer member, while the drum 1 is subjected to cleaning. After the cleaning, the drum 1 is again used for the subsequent printing cycle.

The developing device includes a developing roller 8 which is so constructed that an electrically conductive core body 5 such as rigid metal pipe is covered with a porous, resilient layer 6 as, for example, NBR foamed body having liquid absorbing and exuding properties, and the peripheral surface of this layer 6 is further covered with a net 7 of fine mesh size. In the development section where a developing liquid is fed to the photosensitive body, this developing roller 8 is press-contacted to the peripheral surface of the photosensitive body 1 at its peripheral surface as shown in the drawing, as the consequence of which the layer 6 is subjected to elastic deformation at this press-contacted portion. A reference numeral 9 designates a developing liquid holding trough which is confronted to the peripheral surface of the developing roller 8 with a small space gap therebetween. Into this space gap, there is poured the developing liquid L pumped up from a liquid vessel 10 by a pump 11 through a pipe 12. This developing liquid fills in the space gap, and flows through this gap to feed the developing liquid onto the peripheral surface of the developing roller 8 in intimate contact thereto. A numeral 13 refers to a refreshing roller which is disposed in the vicinity of an outlet of the poured developing liquid. The peripheral surface of this refreshing roller is press-contacted to the peripheral surface of the developing roller 8 as shown in the drawing. The developing liquid which has flown through the space gap reaches an outlet side of the trough at the press-contacted portion of the rollers 8 and 13 relative to the rotational direction of the roller 8, as shown in the drawing, and flows down into the liquid reservoir 10 along the peripheral surface of the roller 13. As illustrated, the porous, resilient layer 6 of the developing roller 8 is subjected to elastic deformation and compressed. During this compression deformation of the developing roller 8, the developing liquid which has been used in the developing process is squeezed out of the layer 6, and the thus squeezed liquid flows down into the liquid reservoir 10 along the peripheral surface of the roller 13 as shown in the drawing. On the other hand, while the roller is restoring from its compression deformation to the original uncompressed state, the porous, resilient layer 6 absorbs a large quantity of fresh developing liquid which has arrived at the outlet of the trough 9 where the rollers 8 and 13 are about to be released from this mutually press-contacted state relative to the rotational direction of the roller 8. With rotation of the roller 8, the layer 6 further absorbs the developing liquid, while it is passing through the abovementioned space gap between the roller 8 and the developing liquid holding trough 9, and reaches its saturated state. Incidentally, the layer 6 absorbs the developing liquid even by causing it to contact the developing liquid only after the deformation of the layer 6 due to the refreshing roller 13 has been perfectly reinstated. In so doing, however, the layer 6 takes therein a large quantity of air at the time of its elastic restoration. Therefore, it is more preferable to feed the fresh developing liquid into the layer 6 at the time of the elastic restoration, as already mentioned above. In any case, the portion which causes the fresh developing liquid to be absorbed in the porous, resilient layer 6 of the roller 8 will be termed "feeding section S".

The developing roller 8 which has received a supply of the developing liquid at the feeding section S arrives at the press-contacted portion with the photosensitive drum 1 in a state of it having a thin layer of the developing liquid on its surface, whereupon the layer 6 of the roller 8 is subjected to elastic compression deformation due to press-contact between them to thereby ooze out the developing liquid impregnated therein. This squeezed out developing liquid contacts the photosensitive body, and the electrostatic image is developed thereby throughout the present specification, the section where the development of the electrostatic image proceeds with the abovementioned exuded developing liquid is termed "developing section "). At the time of its elastic restoration from the compression-deformation at the developing section, the layer 6 of the developing roller 8 absorbs and removes from the surface of the photosensitive member the developing liquid containing the residual toner which has not been used for the electrostatic image development. On account of this, possibility of fogging and quantity of liquid to be adhered onto the image transfer material become reduced in comparison with the conventional wet-type developing methods such as, for example, the cascade development, welling portion of the development, and so forth. The developing roller 8 which has passed through the developing section and has been elastically restored continues its rotation and reaches the abovementioned refreshing roller 13. Incidentally, the refreshing roller 13 is rotationally driven in the same arrow direction and at the same circumferential speed as those of the photosensitive drum 1 by receiving the rotational force of the drum 1 through the gear trains 20, 21 in FIG. 2. On the other hand, the developing roller 8 is supported in a freely rotatable manner on a supporting means (not shown), and is so constructed that it may rotate in the arrow direction by a frictional force caused by the drum 1 and the roller 13 at the time of their rotation. Accordingly, both developing roller 8 and photosensitive drum 1 move in the same direction and at the same circumferential speed at the press-contacted portion, whereby the image as developed is in no way destroyed. Also, an adjusting device for maintaining constant the toner density of the developing liquid is provided in the liquid reservoir 10.

In order to secure stability of the developed image at the time of development, and to prevent the photosensitive member from undesirable fogging—a phenomenon, in which the developing toner electrostatically adheres onto the non-image region of the electrostatic image on the surface of the photosensitive body where no toner should primarily migrate (e.g., a latent image region corresponding to the white ground in an image original, when a positive image reproduction of a black letter original is to be produced on a white background; the latent image region corresponding to the black letter is termed "image region of an electrostatic image") due to Van der Waals force or minor residual charge, it is desirable that an appropriate bias voltage (including a ground voltage, if such is proper) is applied to the developing roller 8 to thereby form, between the roller 8 and the photosensitive drum 1, an electric field which electrostatically attracts and moves the toner liable to cause the fogging phenomenon from the photosensitive body to the side of the developing roller 8. Various methods can be contemplated for this purpose, among which a method of rendering the porous, resilient layer 6 to be electrically conductive and the net which directly contacts the surface of the photosensitive body to be electrically insulative, and of applying a fog preventive voltage as the developing bias voltage to the core metal 5 through conductive means such as lead wire 2, and others, is preferable.

In more detail, the developing roller 8 in FIG. 1 is manufactured by covering the rigid electrically conductive core member 5 such as stainless steel, etc. with the porous, resilient layer 6 such as NBR sponge, etc. which has been made electrically conductive by mixing of carbon powder, etc., and further covering the surface of the porous, resilient layer 6 with the electrically insulative net 7 in fine mesh size made of material such as polyamide, etc. The electrically conductive trough 9 is made of metal alone such as stainless steel and so forth. The refreshing roller 13 is also made of metal alone such as stainless steel, etc., hence it is rigid and electrically conductive. A reference numeral 14 designates a potential detecting means which is adjacent to the surface of the photosensitive member at a position after formation of the electrostatic image on the photosensitive body 1 and prior to development, and detects the surface potential of the electrostatic image. A numeral 15 refers to a bias voltage source which applies a fog preventive bias voltage to the core member 5 of the developing roller 8 through the lead wire 2. The lead wire 2 is connected to the core member 5 by a brush contact 3. A signal formed by the potential detecting means 14 is transmitted to control means 14' to control the bias voltage source 15, and adjust the bias voltage to be applied to the core member 5 of the developing roller 8 in accordance with the potential state of the electrostatic image to be developed. Incidentally, details about the control means 14' may be found in Japanese patent application No. 53-103040. For example, in an electrophotographic device which is so established that the surface potential of the image portion of the electrostatic image is higher than that of the non-image portion thereof, the minimum value of the surface potential of the electrostatic image is detected, and a voltage which is a sum of this minimum potential value and a value of a predetermined voltage (which should be smaller than the surface potential of the image portion) is applied to the abovementioned electrically conductive core member 5.

In any case, by application of the developing bias voltage to the core member 5 as mentioned above, the surface potential of the electrically conductive sponge layer 6 of the developing roller 8 assumes a value between the surface potential value of the image portion and the non-image portion of the electrostatic image, whereby the toner which tends to adhere onto the non-image portion is attracted and migrated to the side of the roller 8 from the photosensitive member, and the undesirable fogging phenomenon is thus prevented. Incidentally, the bias voltage application to the developing roller 8 is not limited to the abovementioned example. For instance, if the surface potential of the image portion of the electrostatic image is positive and that of the nonimage portion is negative, the core 5 of the developing roller 8 may always be grounded electrically irrespective of variations in the minimum potential (in this case, too, it is understood that the bias voltage is applied to the roller 8). Or, a voltage of a certain definite value between the upper limit value (of the absolute value) of the variations in the minimum potential in the electrostatic image to be forecast and a surface potential value of the image portion of the electrostatic image may be uniformly applied to the core member 5 of the roller 8 irrespective of variations in the minimum potential of the electrostatic image. In these cases, the potential detecting means 14, 14' are unnecessary. In order to apply the bias voltage to the roller 8, there may be adopted well known electrical connecting means such that the brush contact 3 is slide-contacted on the peripheral surface of the core member 5. Further, in order to electrically ground the core member 5, hence the electrically conductive sponge layer 6 of the developing roller 8, no special lead wire, etc. needs be used, but the supporting means such as, for example, bearing, arm, etc., of these members are made electrically conductive so that these supporting means may be rendered electrically conductive with the wall of the image processing device.

In one embodiment shown in FIG. 1, the refreshing roller 13 is made of an insulative material alone such as synthetic resins, etc. With such insulative material, even when the fog preventive bias voltage is applied to the developing roller 8 as mentioned above, there is formed no electric field capable of substantially moving the toner between the developing roller 8 and the refreshing roller 13, hence the afore-described inconveniences can be solved. Also, there is no possibility of the bias voltage leaking from the electrically conductive sponge layer 6.

However, the roller made of synthetic resins and other insulative material has such disadvantages that its rigidity is generally small, hence it is flexed in the longitudinal direction due to the press-contact with the developing roller 8 and becomes difficult to maintain uniform press-contact force, and utmost care is required in precise working of the material into a roller. Therefore, the material cannot be said to be well adapted for the purpose, as the solution to such problem, the roller 13 in FIG. 1 is constructed with a metal material such as stainless steel, etc. so that the electrically conductive metal roller 13 may be maintained in an electrically floated state.

Figure 2:
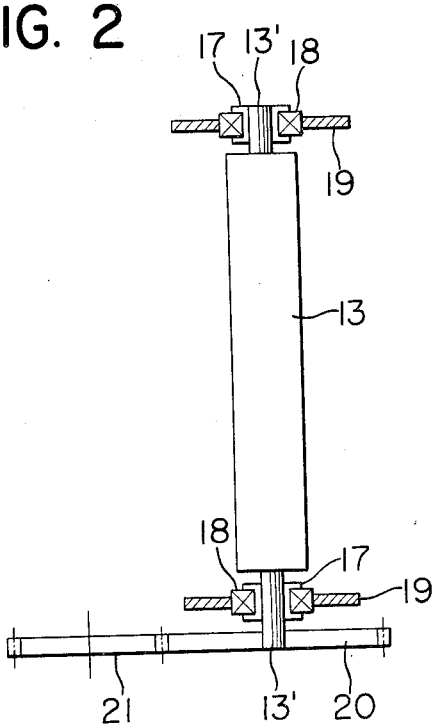
FIG. 2 is an explanatory view of the main part of one embodiment of the present invention.

FIG. 2 shows one example of a method for maintaining the refreshing roller 13 made of an electrically conductive metal in an electrically floated state. Both ends of the shaft 13' of the roller 13 are rotatably held on bearings 18, 18 through insulative sleeves 17, 17 such as nylon, etc. The bearings 18, 18 are mounted on their supporting members 19, 19. At one extreme end of the shaft 13' of the roller 13, there is fixedly mounted a gear 20 made of an insulative material such as nylon, etc. The insulative gear 20 is meshed with a gear 21 which transmits rotational force of the abovementioned photosensitive drum 1. The bearing 18, the supporting member 19, and the gear 21 may be made of electrically conductive metal. In any case, the roller 13 is electrically insulated from the supporting means and the rotational force transmitting means, as mentioned in the preceding. In other words, the roller 13 is maintained in an electrically floated state. As the consequence of this, the roller 13 is maintained at the substantially same potential level as that of the developing roller 8, to which the fog preventive bias voltage has been applied, and no electric field of an intensity which causes the toner to migrate is formed between the rollers 8 and 13, so that the above-mentioned various inconveniences and disadvantages can be eliminated. Besides constructing the roller 13 with an electrically conductive material to the surface thereof, the metal roller surface may also be coated with a thin layer of insulating material such as tetrafluoroethylene resin, etc., onto which the toner is difficult to adhere.

The trough 9 may be made of a synthetic resin material and other insulative material. From the standpoints of mechanical strength, workability, etc. of the material, however, when it is constructed with an electrically conductive material such as metals, the trough 9 may also be maintained in an electrically floated state as is the case with the roller 13. As mentioned above, however, since a space gap is formed between the developing roller 8 and the electrically conductive trough 9 to hold and guide the developing liquid, even when electrostatic induction phenomenon takes place in the electrically conductive trough 9, the surface potential of the trough 9 obtained thereby is lower than the surface potential of the roller 13. Accordingly, there is formed between the roller 8 and the trough 9 an electric field having a certain degree of intensity, by the electrostatic force of which some of the toner moves from the roller 8 to the trough 9, or vice versa. On the other hand, since the trough 9 is not a movable part, there arises no trouble due to insufficient contact, even when the contact 3' is provided. Accordingly, it will be better to apply a voltage from the power source 15 to the trough 9 through the lead wire 2', as illustrated. In other words, it is preferable that the trough 9 be applied with the same bias voltage as that applied to the electrically conductive foamed body of the roller 8, and that the bias voltage be adjusted in accordance with the potential state of the electrostatic image as mentioned above. In any case, by application of the same bias voltage to both roller 8 and trough 9, there is formed no electric field in both of them, and migration of the toner between them can be prevented.

Figure 3:
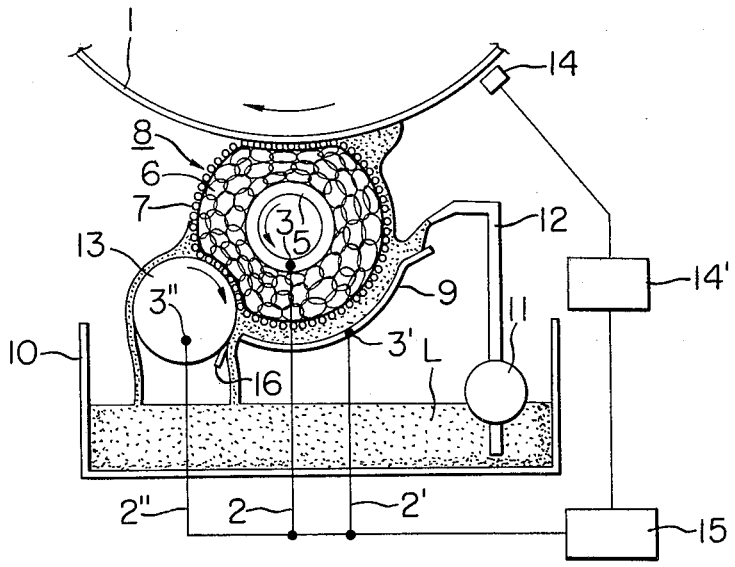
FIG. 3 is a schematic side elevational view showing a main part of another embodiment of the present invention.

While, in the above-described embodiment, the trough 9 may be constructed with an electrically conductive material to the surface thereof, it may also be possible to apply a thin layer of an insulative material such as tetrafluoroethylene resin, etc., to which the toner is difficult to adhere, onto the surface at the side thereof confronting to the roller 8 of the electrically conductive trough substrate. To this electrically conductive trough substrate, the abovementioned bias voltage is applied, or the electrically conductive trough substrate is maintained in an electrically floated state. In order to maintain the electrically conductive trough 9 in an electrically floated state, a spacer of a synthetic resin and other insulative material is interposed between the trough 9 and a metal supporting member (not shown), and then both trough 9 and the supporting member are electrically insulated. Furthermore, in order not to form an electric field having an intensity to cause the toner to migrate between the roller 8 and the roller 13, there may be applied to the electrically conductive roller 13 by the lead wire 2'' as shown in FIG. 3 a bias voltage same as that applied to the same electrically conductive formed body 6 of the roller 8. In this case, a bruch contact 3'', etc. is slide-contacted to the shaft, etc. of the roller 13, whereby the lead wire 2'' is contacted to the roller 13. When insufficient contact state occurs in the contact 3'', the voltage applied to the developing roller 8 leaks to cause irregularity in the development. Therefore, the member which rotates in press-contact with the developing roller 8 should be constructed with an insulating material. Or, in case it is constructed with an electrically conductive material, it should be maintained in an electrically floated state so as to be held in a state of no current variation.

Also, within the position and extent, wherein the developing liquid flows down from the space gap between the roller 13 and the trough 9 and further flows down along the surface of the roller 13, a cleaning member such as resilient blade, etc. made of insulating rubber, etc. may be contacted on the peripheral surface of the roller 13. In this way, the toner adhered onto the surface of the roller 13 is removed and is recovered into the vessel 10 together with the flow-down liquid. Since the muddy toner is not adhered onto the peripheral surface of the roller 13 for the previously stated reason, satisfactory cleaning effect can be attained even with a simple device such as a blade 16, hence clogging of the fine openings formed in the roller 8 can be more effectively prevented.

To enable those skilled in the art to conduct experiments on this device, the following actual data are provided, which have been obtained on the devices shown in FIGS. 1 and 3.

The photosensitive drum 1 has a diameter of 136 mm and rotates at a circumferential speed of 220 mm/sec. In case an electrostatic image of an original image having a black pattern in the pure white ground is formed under an average environmental condition, the electrostatic image exhibits the surface potential of +500 V at the image portion and −100 V at the non-image portion. The developing roller 8 has a diameter of 40 mm, which is constructed by covering the core metal 5 of 36 mm in diameter with the NBR sponge 6 of 3.5 mm in thickness and rendered electrically conductive, and wrapping the insulative net 7 of polyamide having a mesh size of 200 meshes around this sponge layer 6 so that the final diameter of the developing roller may be 40 mm. The refreshing roller 13 is made of a metal having a diameter of 20 mm, and rotates at the circumferential speed of 220 mm/sec. in synchronism with the photosensitive drum 1. The roller 8 is driven by rotation of the photosensitive drum 1 and the refreshing roller 13. The trough 9 is made of a metal, and positioned at a lower part of the roller 8 with a space gap of 1 to 10 mm therebetween.

In operation, a developing bias voltage was applied to the developing roller 8 through the electrically conductive core 5 as mentioned above. The bias voltage is so controlled that it may assume a value which is a sum of the minimum potential value of the electrostatic image scanned and detected by the detector 14 and a voltage of +100 V added to it. The roller 13 and the trough 9 were mounted on the side of the device main body without an insulative material interposed therebetween, so that the roller 13 and the trough 9 are electrically grounded. In this device, irregular fogging occurred on the background, and the toner turned into muddy form to clog the pores of the roller 8 to thereby lower the image density. When the abovementioned bias voltage was applied to the rollers 8, 13 and the trough 9, as shown in FIG. 3, the toner did not turn into the muddy form, nor did it clog the pores in the roller 8. However, when the insufficient contact takes place in the contact for the bias voltage application to the roller 13, the applied voltage to the development roller 8 leaked out to cause irregularity in development from time to time.

Therefore, using the device of FIG. 1, the abovementioned voltage was applied to the roller 8 and the trough 9, while the roller 13 was maintained in an electrically floated state as shown in FIG. 2. It was found out that not only a favorable image free from the ground fogging could be obtained, but also the abovementioned irregularity in the development due to potential variations caused by the voltage leak from the roller 8 did not occur at all. It goes without saying that occurrence of muddy toner could not be observed.

The experimental result reveals that the bias voltage applied to the roller 8 may be in a value which is a sum of the abovementioned minimum potential value plus 0 to +200 V, in the case of applying a voltage having a value which is a sum of the minimum potential obtained by scanning and measuring of the surface potential of the electrostatic image as mentioned above plus a certain definite predetermined voltage. In this way, the fogging can be prevented.

In order also to obtain an image having a reflective density of 1.0 and higher by developing the image portion having the surface potential of +500 V, it was found out preferable that the developing liquid to be used had an extremely high toner contact, in which a light transmission factor was in a range of 25 to 35% in its state of being diluted with a carrier liquid by five times. Thus, even when the developing liquid of very high density is used, stable developing capability can be maintained with the device of the present invention.

Incidentally, the present invention can be utilized not only in the image transfer type electrophotography, but also in the electrophotographic system, wherein the toner image formed on the photosensitive paper is fixed thereon as it is. Further, the present invention can be utilized for all kinds of image processing methods and apparatuses which include the steps of electrostatic image formation and development thereof, not limiting to the electrophotography alone. Furthermore, the development member is not limited to the roller, but there may also be used a porous, resilient body which is so constructed as to perform a circulatory motion along an endless path such as an endless belt, etc.

What we claim is:

1. A device for developing an electrostatic latent image formed on an image carrying member moving along a predetermined path with a liquid developer, comprising:

(a) a porous developing member having resiliency, said developing member being press-contacted to said image carrying member at a developing position so as to be elastically deformed, and movable along an endless path between said developing position and a developing liquid exchanging position;

(b) means for applying a developing bias voltage to said resilient, porous developing member with respect to said image carrying member;

(c) rotatable refreshing means press-contacted to said resilient, porous developing member at said developing liquid exchanging position to elastically deform said developing member to discharge the developing liquid which has been used for development; and to absorb thereinto fresh developing liquid, said refreshing means being electrically conductive; and (d) insulating means for maintaining said electrically conductive refreshing means in an electrically floated state to prevent formation of an electric field between said developing member and refreshing means.

2. A device according to claim 1, wherein said refreshing means includes a roller.

3. A device according to claim 2, wherein said insulating means includes an insulating supporting member for supporting a shaft of said refreshing means.

4. A device according to claim 2, further comprising means for driving said refreshing means through a rotating force transmitting means made of an insulating material.

5. A device according to claim 2, wherein said developing member is rotated by the frictional force caused by the rotation of said refreshing means and the movement of said image carrying member.

6. A device according to claim 1, 2, 3, 4 or 5 wherein said developing member comprises an electrically conductive sponge and an electrically insulative net-shaped member covering the surface of said electrically conductive sponge, and the developing bias voltage is applied to said electrically conductive sponge.

7. A device according to claim 6, wherein said developing member includes a conductive core roll, which is covered by said sponge, and wherein said developing bias applying means applies a voltage to said sponge through said core roll.

8. A device according to claim 7, wherein the developing bias applied to said developing member has a value between that of the surface potential of the imaging area of the electrostatic image formed on said image carrying member and that of the surface potential on the non image area thereof.

9. A device according to claim 8, wherein said developing bias applying means includes means for detecting the surface potential of the electrostatic image formed on said image carrying member, and means for adjusting the developing bias in accordance with the detected surface potential.

10. A device for developing an electrostatic latent image formed on an image carrying member moving along a predetermined path with a liquid developer, comprising:

(a) a porous developing member having resiliency, said developing member being press-contacted to said image carrying member at a developing position so as to be elastically deformed, and movable along an endless path between said developing position and a developing liquid exchanging position;

(b) means for applying a developing bias voltage to said resilient, porous developing member with respect to said image carrying member;

(c) rotatable refreshing means press-contacted to said resilient, porous developing member at said developing liquid exchanging position to elastically deform said developing member to discharge the developing liquid which has been used for development, and to absorb thereinto fresh developing liquid, said refreshing means comprising an electrically conductive member coated with an insulative thin layer; and (d) insulating means for maintaining said electrically conductive member in an electrically floated state to prevent formation of an electric field between said developing member and refreshing means.

11. A device according to claim 10, wherein said conductive member includes a roller.

12. A device according to claim 11, wherein said developing member is rotated by the frictional force caused by the rotation of said refreshing means and the movement of said image carrying member.

13. A device according to claim 10, wherein said insulating layer is of a synthetic resin onto which toner in the liquid developer does not easily attach.

14. A device according to claim 10, further comprising means for driving said conductive member through an insulating rotational force transmitting member.

15. A device according to claim 10, further comprising means for driving said conductive member through an insulating transmitting member.

16. A device according to claim 10, 11, 13, 14 or 15 wherein said developing member comprises an electrically conductive sponge and an electrically insulating net-shaped member covering the surface of said electrically conductive sponge, and said developing bias voltage is applied to said electrically conductive sponge.

17. A device according to claim 16, wherein said developing member includes a conductive core roll which is covered by said sponge, and wherein said developing bias applying means applies a voltage to said sponge through said core roll.

18. A device according to claim 17, wherein the developing bias applied to said developing member has a value between that of the surface potential of the imaging area of the electrostatic image formed on said image carrying member and that of the surface potential of the non image area thereof.

19. A device according to claim 18, wherein said developing bias applying means includes means for detecting the surface potential of the electrostatic image formed on said image carrying member, and means for adjusting the developing bias in accordance with the detected surface potential.

20. A device for developing an electrostatic latent image formed on an image carrying member moving along a predetermined path with a liquid developer, comprising:

(a) a porous developing member having resiliency, said developing member being press-contacted to said image carrying member at a developing position so as to be elastically deformed, and movable along an endless path between said developing position and a developing liquid exchanging position;

(b) means for applying a developing bias voltage to said resilient, porous developing member with respect to said image carrying member; and (c) rotatable refreshing means press-contacted to said resilient, porous developing member at said developing liquid exchanging position to elastically deform said developing member to discharge the developing liquid which has been used for development, and to absorb thereinto fresh developing liquid, said refreshing means being made of an insulating material to prevent formation of an electric field between said developing member and refreshing means.

21. A device according to claim 20, wherein said refreshing means includes an insulating roller.

22. A device according to claim 21, wherein said developing member is rotated by the frictional force caused by the rotation of said refreshing means and the movement of said image carrying member.

23. A device according to claim 20, 21 or 22 wherein said developing member comprises an electrically conductive sponge and an electrically insulative net-shaped member covering the surface of said electrically conductive sponge, and said developing bias voltage is applied to said electrically conductive sponge.

24. A device according to claim 23, wherein said developing member includes a conductive core roll, which is covered by said sponge, and wherein said developing bias applying means applies a voltage to said sponge through said core roll.

25. A device according to claim 24, wherein the developing bias applied to said developing member, has a value between that of the surface potential of the imaging area of the electrostatic image formed on said image carrying member and that of the surface potential of the non image area thereof.

26. A device according to claim 25, wherein said developing bias applying means includes means for detecting the surface potential of the electrostatic image formed on said image carrying member, and means for adjusting the developing bias in accordance with the detected surface potential.

27. A device according to claim 1, 2, 3, 4, 5, 10, 11, 13, 14, 15, 20, 21 or 22, further comprising, a trough member to feed fresh developing liquid to the outlet region at the press-contacted portion of the developing member and refreshing member with respect to the moving direction of said developing member, said member being positioned in facing relationship with said developing member with a small gap therebetween for maintaining the developing liquid.

28. A device according to claim 27, wherein said trough member is conductive, and the same bias voltage as applied to said developing member is applied thereto.

29. A device according to claim 27, wherein said trough member is conductive, and electrically isolated.

30. A device according to claim 27, wherein said trough member includes a conductive base provided with an insulating thin layer at its side facing said developing member, and the same bias voltage as applied to said developing member is applied thereto.

31. A device according to claim 27, wherein said trough member includes a conductive base provided with an insulating thin layer at its side facing said developing member, and the base is electrically isolated.

32. A device according to claim 27, wherein said trough member is made of insulating material.

33. A device for developing an electrostatic latent image formed on an image carrying member moving along a predetermined path with a liquid developer, comprising:

(a) a porous developing member having resiliency, said developing member being press-contacted to said image carrying member at a developing position so as to be elastically deformed, and movable along an endless path between said developing position and a developing liquid exchanging position;

(b) means for applying a developing bias voltage to said resilient, porous developing member with respect to said image carrying member;

(c) refreshing means press-contacted to said resilient, porous developing member at said developing liquid exchanging position to elastically deform said developing member to discharge the developing liquid which has been used for development, and to absorb thereinto fresh developing liquid;

(d) a trough member to feed fresh developing liquid to the outlet region at the press-contacted portion of the developing member and refreshing member with respect to the moving direction of said developing members, said trough member being positioned in facing relationship with said developing member with a small gap therebetween for maintaining the developing liquid, wherein said trough member is conductive; and (e) means for electrically connecting said trough member and said developing member to thereby maintain them at the same voltage.

34. A device according to claim 33, wherein said trough member includes a conductive base provided with a synthetic resin member at its side facing said developing member, and said base is electrically isolated.

35. A device for developing an electrostatic latent image formed on an image carrying member moving along a predetermined path with a liquid developer, comprising:

(a) a porous developing member having resiliency, said developing member being press-contacted to said image carrying member at a developing position so as to be elastically deformed, and movable along an endless path between said developing position and a developing liquid exchanging position;

(b) means for applying a developing bias voltage to said resilient, porous developing member with respect to said image carrying member;

(c) refreshing means press-contacted to said resilient, porous developing member at said developing liquid exchanging position to elastically deform said developing member to discharge the developing liquid which has been used for development, and to absorb thereinto fresh developing liquid; and (d) a trough member to feed fresh developing liquid to the outlet region at the press-contacted portion of the developing member and refreshing member with respect to the moving direction of said developing member, said trough member being positioned in facing relationship with said developing member with a small gap therebetween for maintaining the developing liquid, wherein the side of said trough member facing said developing member is made of a synthetic resin insulating material.

36. A device according to claim 33, 34 or 35, wherein the developing bias applied to said developing member has a value between that of the surface potential of the imaging area of the electrostatic image formed on said image carrying member and that of the surface potential of the non image area thereof.

37. A device according to claim 36, wherein said developing bias applying means includes means for detecting the surface potential of the electrostatic image formed on said image carrying member, and means for adjusting the developing bias in accordance with the detected surface potential.

* * * * *

UNITED STATES PATENT AND TRADEMARK OFFICE

CERTIFICATE OF CORRECTION

PATENT NO. : 4,327,664

DATED : May 4, 1982

INVENTOR(S) : YASUHIRO OHKAWA, ET AL.

It is certified that error appears in the above-identified patent and that said Letters Patent is hereby corrected as shown below:

Column 4, line 44, after "welling" delete --portion of the--;
line 45, before "developing" add --portion of the--.

Column 8, line 6, after "voltage" add --the--;
line 7, delete "same" (second occurrence);
line 8, change "bruch" to --brush--.

Signed and Sealed this

*Twenty-first* Day of *June 1983*

[SEAL]

*Attest:*

DONALD J. QUIGG

*Attesting Officer*

*Acting Commissioner of Patents and Trademarks*